United States Patent [19]

Gross

[11] 4,001,630

[45] Jan. 4, 1977

[54] SELECTIVELY DAMPED TRAVELLING WAVE TUBE

[75] Inventor: Franz Gross, Munich, Germany

[73] Assignee: Siemens Aktiengesellschaft, Berlin & Munich, Germany

[22] Filed: July 17, 1975

[21] Appl. No.: 596,643

Related U.S. Application Data

[63] Continuation of Ser. No. 465,260, April 29, 1974, abandoned.

[30] Foreign Application Priority Data

May 21, 1973 Germany ..... 2325716

[52] U.S. Cl. ..... 315/3.5; 315/3.6; 331/82

[51] Int. Cl.[2] ..... H01J 25/34

[58] Field of Search ..... 315/3.5, 3.6, 39.3; 331/82

[56] References Cited

UNITED STATES PATENTS

| | | | |
|---|---|---|---|
| 3,221,204 | 11/1965 | Hant et al. | 315/39.3 X |
| 3,221,205 | 11/1965 | Sensiper | 315/39.3 |
| 3,329,855 | 7/1967 | Landsbergen | 315/3.5 |
| 3,360,679 | 12/1967 | Rubert | 315/3.5 |
| 3,412,279 | 11/1968 | Allen et al. | 315/3.5 |
| 3,602,766 | 8/1971 | Grant | 315/3.5 |
| 3,771,010 | 11/1973 | Winslow | 315/3.5 |

*Primary Examiner*—Saxfield Chatmon, Jr.
*Attorney, Agent, or Firm*—Hill, Gross, Simpson, Van Santen, Steadman, Chiara & Simpson

[57] ABSTRACT

Selectively damped travelling wave tubes having particularly periodically alternating magnetic field for guiding the electron beam comprise a delay line consisting of cells which are separated from each other by partitions and which are positioned one behind the other in the direction of beam travel. At least one resonator chamber is provided with damping material and coupled to at least one of the cells, the resonant frequency of the resonator chamber being at least almost equivalent to a predetermined interference frequency and each of the chamber resonators formed by a recess in a partition and its resonant frequency having the most energetic oscillation corresponding at least approximately to the frequency of an interference mode which is above the operational frequency band.

6 Claims, 5 Drawing Figures

SELECTIVELY DAMPED TRAVELLING WAVE TUBE

This is a continuation, of application Ser. No. 465,260, filed Apr. 29, 1974, now abandoned.

BACKGROUND OF THE INVENTION

1. Field of the Invention

This invention relates to a selectively damped travelling wave tube having a periodically alternating magnetic field for guiding the electron beam and comprising a delay line consisting of cells which are separated from each other by partitions and which are positioned one behind the other in the direction of the beam, wherein at least one chamber resonator is provided with damping material and coupled to at least one of the cells, the resonant frequency of the chamber resonator being at least almost equivalent to a predetermined interference frequency.

2. Description of the Prior Art

In general, such a travelling wave tube is known from the German Letters Patent 1,297,768. Embodiments of travelling wave tubes are disclosed in this publication in which chamber resonators are inserted into non-magnetic spacers which are arranged between adjacent partitions. The spacers are shaped like rings which are provided with tongues and are encased by the guide magnet of the tube. With this resonator arrangement, in particular with delay lines having a periodically alternating guide field, additional radial asymmetries or weakings, respectively, of the axial field strength occur which are known to be able to greatly impair beam guidance. If it is desired to adjust the asymmetry by means of maintaining a constant outer diameter at the spacers, an increase of the transverse dimensions and of the weight of the tube will simultaneously be required and, in addition, if the same magnetic power is applied, an altogether weakened guide field will result, even though it is radially symmetrical.

SUMMARY OF THE INVENTION

It is therefore the object of the present invention to improve a travelling wave tube of the type mentioned above in such a way that the oscillations of high frequency interfering modes is prevented and that the tube can be supported in a space and weight saving manner without accepting radial asymmetric weakenings in the magnetic guide field.

According to the invention, the above object is achieved by forming each of the chamber resonators with a recess in a partition to permit the resonant frequency with the most energetic oscillation correspond at least approximately to the frequency of an interference mode which is above the operational frequency band.

In the case of a delay line of the type mentioned above, it is already known in the art to insert button-shaped damping elements into recesses of partitions; for example, one may refer to the German Letters Patent 1,274,742, or to the initially mentioned Letters Patent. The damping elements are intended for a non-selective, reflection-free division of cells into cells groups: influences of dimensions of the recesses are not considered.

BRIEF DESCRIPTION OF THE DRAWINGS

Other objects, features and advantages of the invention, its organization, construction and operation will be best understood from the following detailed description of preferred embodiments of the invention taken in conjunction with the accompanying drawings, on which.

Figure 2:
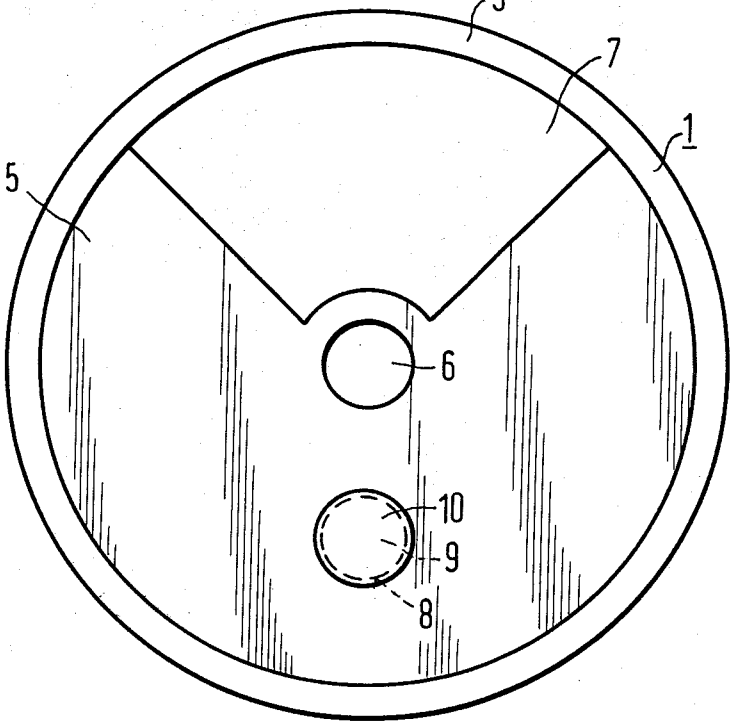
FIG. 2 is an end view of the apparatus of FIG. 1 as viewed from the left side of the drawing.

Certain parts in structural components of the travelling wave tube which are not important for understanding the invention, for example the system producing the electron beam, the collector or the focusing magnet, are not illustrated in the drawing.

DESCRIPTION OF THE PREFERRED EMBODIMENTS

Figure 1:
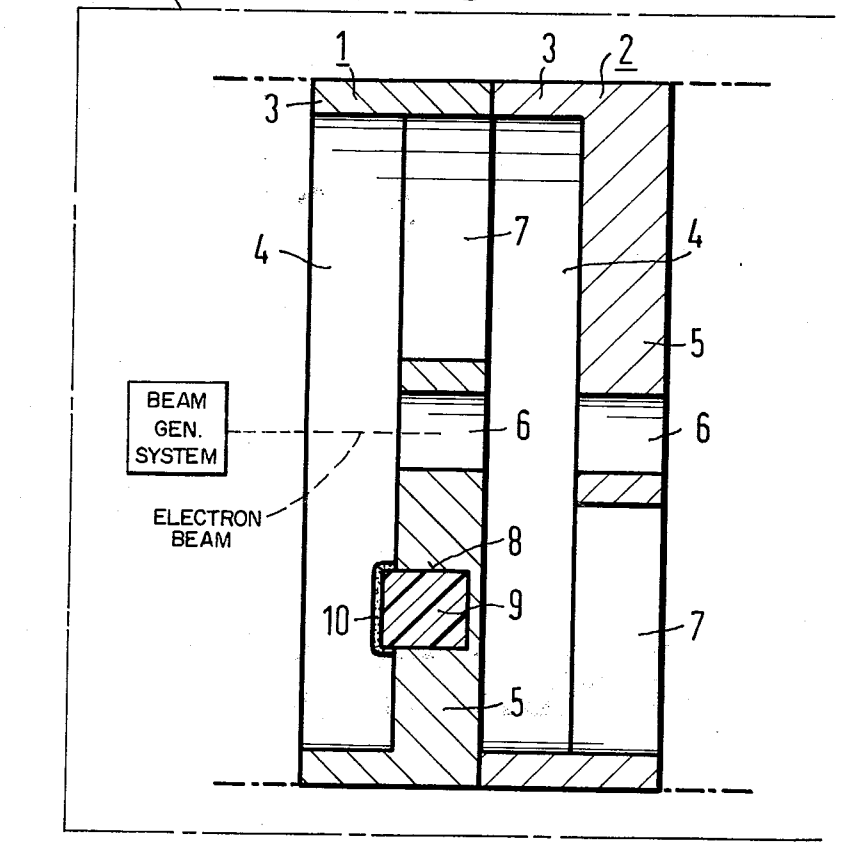
FIG. 1 is a longitudinal sectional view of an exemplary embodiment of a travelling wave tube constructed in accordance with the invention, showing a period of its delay line.

The delay line illustrated in FIGS. 1 and 2 is provided for a travelling wave tube for the amplification of extremely high frequencies (EHF). The delay line itself comprises conductor discs 1, 2 which are arranged one behind the other in the direction of the electron beam travel and which are fastened in a stackig manner of construction to a rigid conductor block (not shown).

With the exception of a continuous flange 3, each conductive disc is recessed in such a way that cells 4 are formed divided by the cells dividing partitions 5. The partitions 5 each have a central aperture 6 for receiving the electron beam therethrough as well as a coupling opening 7. Each of the consecutive conductive discs is staggered by 180°, with respect to the coupling openings 7, and each pair of discs forms a period of the delay line.

In the exemplary embodiment illustrated in these figures, a blind bore 8 is bored into the conductor disc 1 opposite the coupling opening 7 for the selective damping of high frequency interference modes. A solid dielectric rod 9 is soldered into the blind bore 8. This solid rod 9 carried on its front end a material 10 which is subject to loss, for example a graphite suspension. The blind bore acts, together with the damped solid dielectric rod, in the manner of a unilaterally closed chamber resonator which is to be dimensioned in such a way that its resonant frequency—in consideration of the dielectric constant of the solid dielectric rod as well as of the stray field on the open side of the chamber resonator—is tuned to the frequency of the interference mode to be damped above the operating frequency band. In the case of the present chamber resonator arrangement, the $H_{111}$ resonance ( $\lambda/4$ resonance) is the one of the greatest damping force and therefore is to be applied to the interference frequency. In this case, the blind bore 8 has a bore diameter of about 1 mm and a depth of about 0.6 mm, for example in the case of a dielectric constant of the rod of 9 for the material $Al_2O_3$ for an interference mode frequency of 80 GHz.

The damping proposed according to the invention is very effective since the damped dielectric rod is located at places of strong E-fields which, in addition, are coupled into the chamber resonator with only little reflection. The coupled-in field are particularly large if the dielectric rod 9 partially protrudes into the space of the cell, as can be seen in the drawing. Difficulties during the dissipation of the heat due to energy losses do not occur since rod and partition and in contact over a large area and the heat paths in the metal of the partition are very wide when the necessary partition thickness exists.

Figure 4:
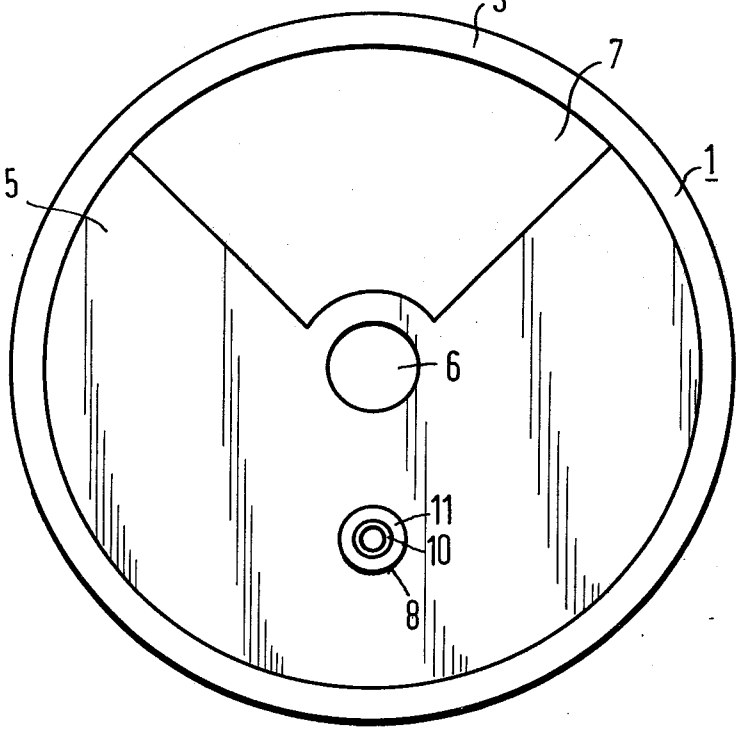
FIG. 4 is an end view of the apparatus of FIG. 3 as viewed from the left side of the drawing.
Figure 3:
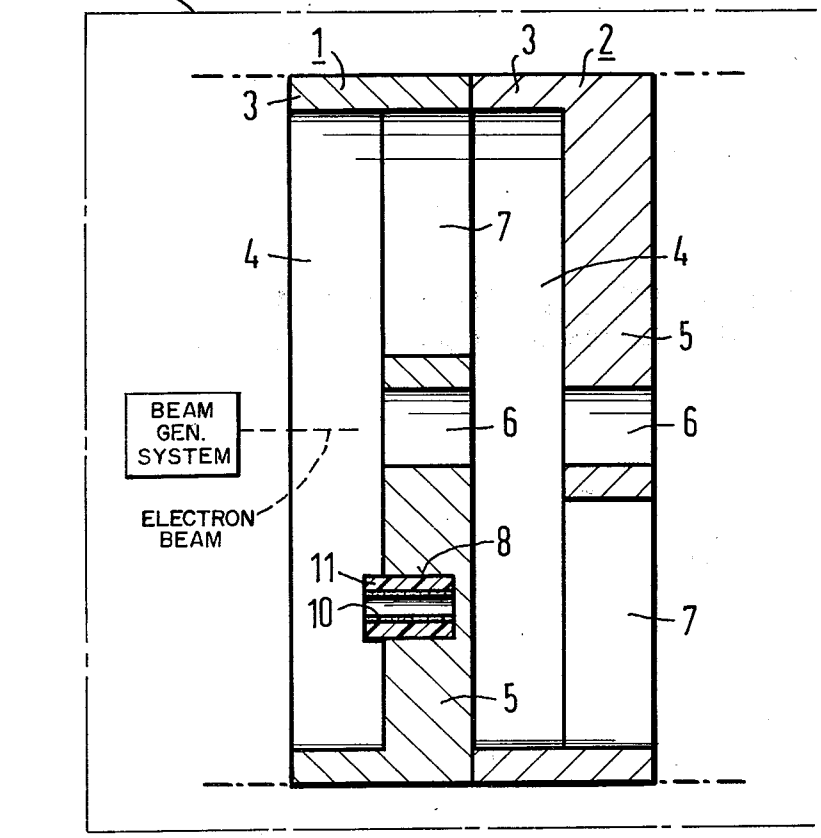
FIG. 3 is a longitudinal sectional view of an exemplary embodiment of the invention showing a period of a delay line of a travelling wave tube.

The second exemplary embodiment illustrated in FIGS. 3 and 4 differs from the first embodiment only in that the dielectric rod inserted into the blind bore 8 is a hollow rod 11 which carries the dissipative material 10 on its inner walls. When the chamber resonator arrangement is altered in this manner, the $E_{010}$ resonance should be applied to the interference frequency to be damped in order to exploit the damping force to its optimum. This resonant frequency is essentially determined by the radial dimensions of the blind bore 8 and by the inside diameter, as well as the dielectric constant, of the hollow rod 11. A blind bore with a hollow rod basically does not damp quite as selectively, with respect to frequency, as a blind bore with a solid rod, but its damping characteristic may be rendered more narrow banded in a simple manner by means of metallizing the front end of the hollow rod.

Figure 5:
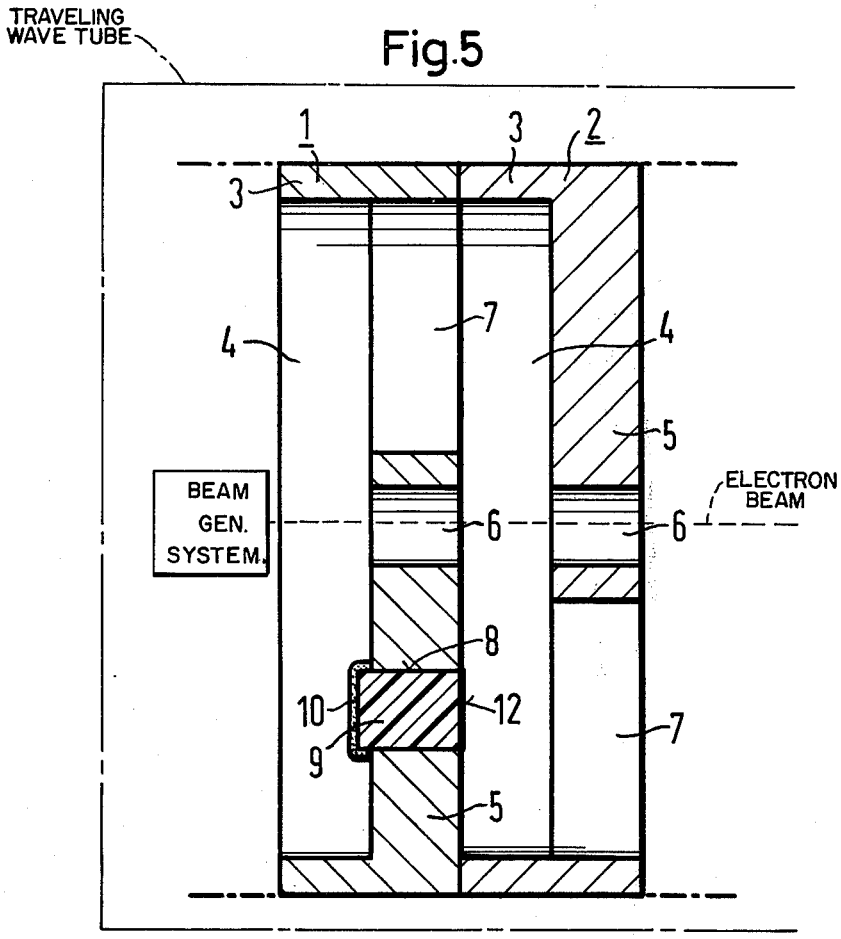
FIG. 5 is a longitudinal sectional view of another embodiment of the invention showing a period of a delay line of a travelling wave tube.

The exemplary embodiment of FIG. 5 deviates from the first embodiment in that instead of a blind bore, through bores are employed which can be produced more easily. The form of a unilaterally closed chamber resonator is maintained since one end of the dielectric rod 9 is closed by a metallization 12. If such a metallization does not take place, different resonant frequencies ( $\lambda/2$ instead of $\lambda/4$ resonance) with other, wider damping characteristics than result; other dimensions would have to be chosen for tuning to the same interference frequencies. In addition to a certain facilitation in production, a non-metallized rod which extends through the partition has the further advantage to simultaneously damp in two adjacent cells.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In a delay line for a travelling wave tube of the type having a periodically alternating magnetic field for guiding an electron beam produced by a beam generating system, said delay line comprising a plurality of partitions dividing said delay line into a plurality of cells positioned one behind the other in the direction of the electron beam, and at least one chamber resonator including damping material and coupled to at least one of the cells and having a resonant frequency that is approximately equal to a predetermined interference frequency, the partitions having axially aligned openings for passage of the electron beam and coupling openings positioned at 180° from one partition to the next, the improvement therein comprising:

a recess in at least one of the partitions defining the chamber resonator located opposite the coupling opening for that partition and having a resonant frequency whose most energetic oscillations corresponds at least approximately to the frequency of an interference mode which is above the operational frequency band, said recess comprising a blind bore extending partially through the partition axially parallel to the longitudinal axis of the delay line.

2. The improved delay line of claim 1, wherein the damping material includes a dielectric rod extending from the chamber recess and lossy material carried on said rod.

3. The improved delay line of claim 2, wherein said rod is a hollow rod and said lossy material is carried on the inner surface of said rod.

4. In a delay line for a travelling wave tube of the type having a periodically alternating magnetic field for guiding an electron beam produced by a beam generating system, said delay line comprising a plurality of partitions dividing said delay line into a plurality of cells positioned one behind the other in the direction of the electron beam, and at least one chamber resonator including damping material and coupled to at least one of the cells and having a resonant frequency that is approximately equal to a predetermined interference frequency, the partitions having axially aligned openings for passage of the electron beam and coupling openings positioned at 180° from one partition to the next, the improvement therein comprising:

a recess in at least one of the partitions defining the chamber resonator located opposite the coupling opening for that partition and having a resonant frequency whose most energetic oscillations corresponds at least approximately to the frequency of an interference mode which is above the operational frequency band, said recess comprising a bore extending through the partition axially parallel to the longitudinal axis of the delay line, said damping material including a dielectric rod in said bore, a metal layer on the end of said rod which faces one of the cells.

5. In the improved delay line according to claim 4, wherein the damping material includes a dielectric rod extending from the chamber recess and lossy material carried on said rod.

6. The improved delay line according to claim 5, wherein said rod is a hollow rod and said lossy material is carried on the inner surface of said hollow rod.

* * * * *